United States Patent [19]

Klingenberg et al.

[11] 4,046,315

[45] Sept. 6, 1977

[54] CENTRIFUGAL SEPARATOR WITH DISCHARGE PUMP

[75] Inventors: James C. Klingenberg, Painesville; Hiralal V. Patel, Euclid; Philip W. Morse, Cleveland Heights, all of Ohio

[73] Assignee: The Weatherhead Company, Cleveland, Ohio

[21] Appl. No.: 625,128

[22] Filed: Oct. 23, 1975

[51] Int. Cl.[2] ..... B04B 9/06; B04B 11/02

[52] U.S. Cl. ..... 233/4; 233/21; 233/23 R; 184/6.28; 417/151

[58] Field of Search ..... 233/4, 23 R, 24, 46, 233/19 R, 19 A, 3; 417/151; 184/6.24, 6.28, 6.21

[56] References Cited

U.S. PATENT DOCUMENTS

| | | | |
|---|---|---|---|
| 1,242,560 | 10/1917 | Kingsbury | 233/4 |
| 2,535,689 | 12/1950 | McMahan | 184/6.28 |
| 3,185,107 | 5/1965 | Dodge | 417/151 |
| 3,432,091 | 3/1969 | Beazley | 233/23 R |

FOREIGN PATENT DOCUMENTS

| | | | |
|---|---|---|---|
| 285,949 | 5/1931 | Italy | 184/6.24 |

*Primary Examiner*—George H. Krizmanich
*Attorney, Agent, or Firm*—McNenny, Pearne, Gordon, Gail, Dickinson & Schiller

[57] ABSTRACT

A centrifugal separator for separating contaminants from contaminated oil and which may be mounted in a variety of positions relative to an engine block is disclosed. The centrifugal separator has a shroud which defines a first chamber and has a hollow rotor rotatably mounted in the first chamber and defining a second chamber. Oil under pressure is admitted to the second chamber and flows into the first through tangential reaction nozzles in the rotor to cause contaminants to migrate toward the sidewall of the second chamber under the influence of centrifugal force. A jet pump is in fluid communication with the first chamber to prevent excess fluid buildup in the first chamber, which would inhibit rotation of the rotor.

6 Claims, 5 Drawing Figures

CENTRIFUGAL SEPARATOR WITH DISCHARGE PUMP

BACKGROUND OF THE INVENTION

Conventional fluid filters, such as oil filters, are basically mechanical strainers which include a filter element having pores which trap and segregate dirt from the fluid. Since the flow through the filter is a function of the pore size, filter flow will decrease as the filter pack becomes clogged with dirt. Since the filtration system must remove dirt at the same rate at which it enters the oil, a clogged conventional pack cannot process enough oil to keep the dirt level of the oil at a satisfactory level. A further disadvantage of some mechanical strainer-type filters is that they tend to remove oil additives. Furthermore, the additives may be depleted to some extent by acting upon trapped dirt in the filter and are rendered ineffective for their intended purpose on a working surface in an engine.

Prior art centrifugal filters have been proposed which do not act as mechanical strainers but, rather, remove contaminants from a fluid by centrifuging. For example, such a filter is shown in U.S. Pat. No. 2,650,022, granted to Fulton et al. In the Fulton et al patent, there is illustrated a hollow rotor which is rotatably mounted on a spindle. The spindle has an axial passageway which conducts oil into the interior of the rotor. Tangentially directed outlet ports are provided in the rotor so that the rotor is rotated upon issuance of the fluid therefrom. Solids, such as dirt, are centrifuged to the sidewalls of the rotor and the dirt may be later removed by disassembling the rotor and scraping the filter cake from the sidewalls. Such centrifugal separators, however, must be located above the sump of the engine to be lubricated, since gravity flow from the engine sump to the centrifugal separator will flood the rotor housing and inhibit rotation of the rotor. In many instances, it is inconvenient to mount the centrifugal separator in a position which would prevent flooding and external plumbing must be resorted to.

SUMMARY OF THE INVENTION

This invention provides a centrifugal separator for removing contaminants from oil which may be mounted in a variety of positions relative to the engine block without the danger of flooding the separator.

The invention includes a centrifugal separator having a shroud defining a first chamber and a hollow rotor rotatably mounted in the first chamber to define a second chamber. Oil under pressure is admitted to the second chamber and flows into the first chamber through tangential reaction nozzles in the rotor to cause contaminants to migrate toward the sidewall of the second chamber under the influence of centrifugal force. A jet pump is in fluid communication with the first chamber to prevent excess fluid build up in the first chamber, which would inhibit rotation of the rotor. The jet pump has a pump chamber in fluid communication with the first chamber and a nozzle which projects into the pump chamber. A portion of the fluid from the engine oil pump is diverted through the nozzle, while another portion is delivered through the tangential nozzles. The nozzle in the pump chamber effectively prevents significant fluid buildup in the first chamber.

DETAILED DESCRIPTION OF THE INVENTION

Figure 1:
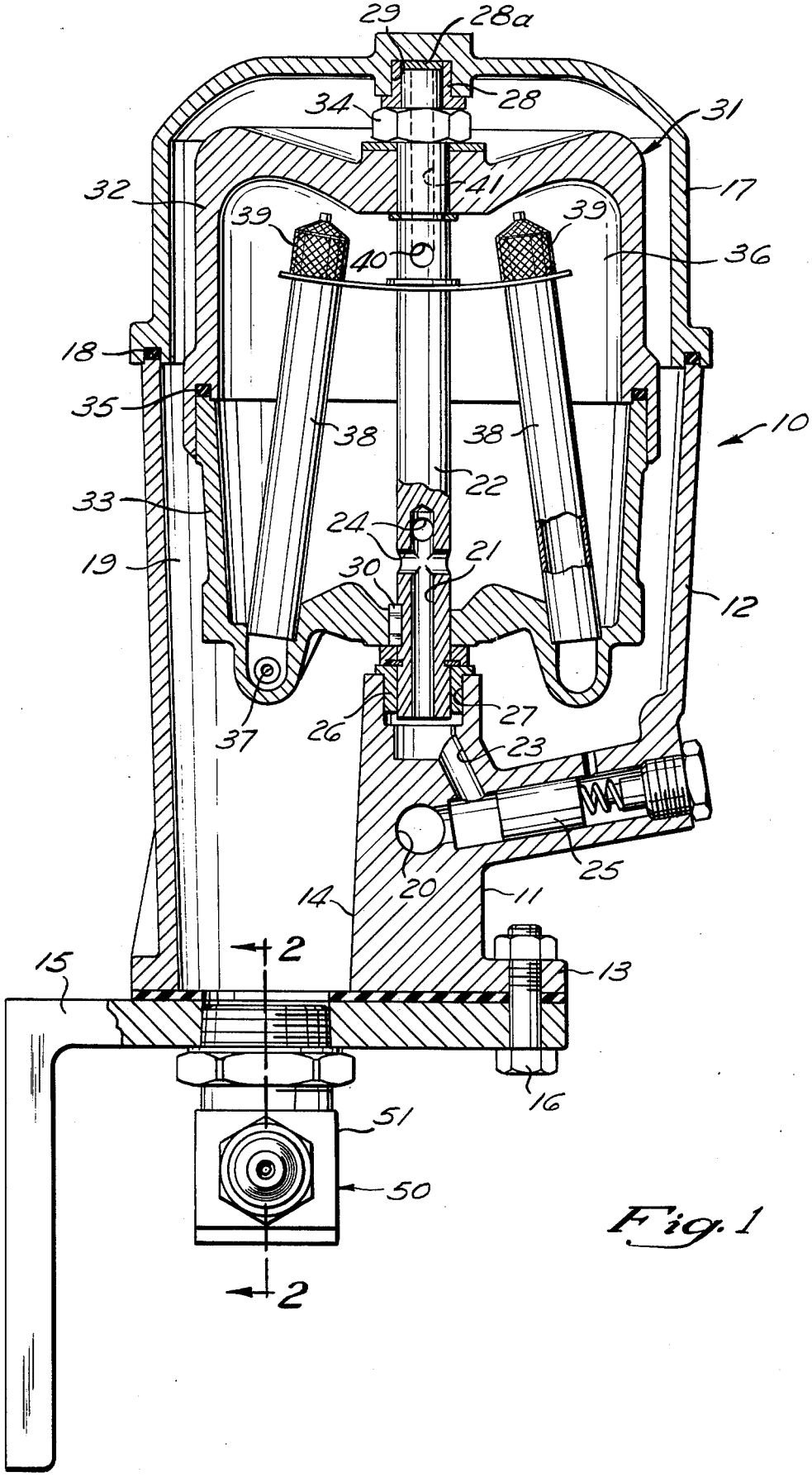
FIG. 1 is an elevational view, partly in section, illustrating a centrifugal filter according to this invention.
Figure 2:
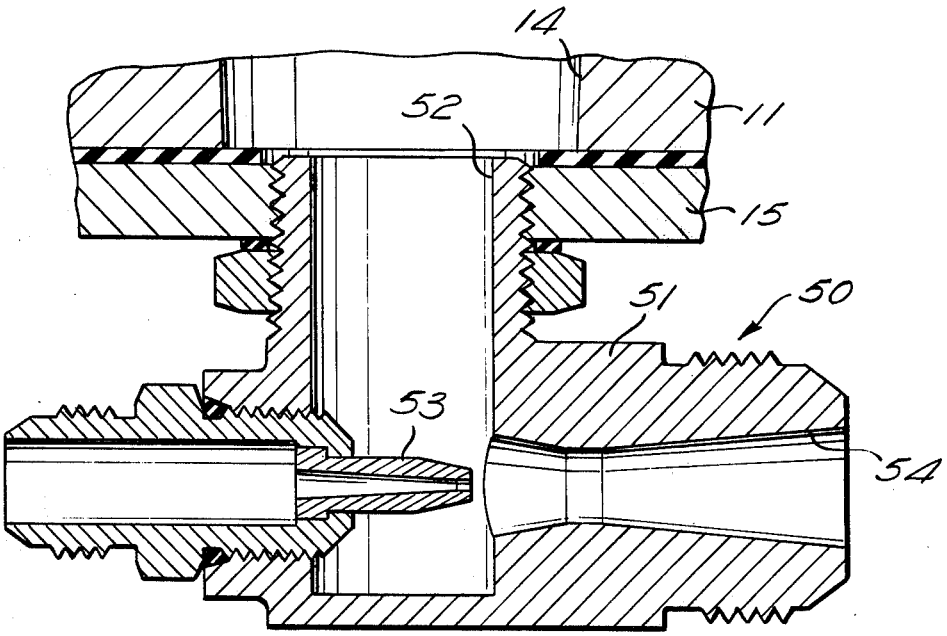
FIG. 2 is a cross sectional view, the plane of the section being indicated by the line 2—2 in FIG. 1.
Figure 3:
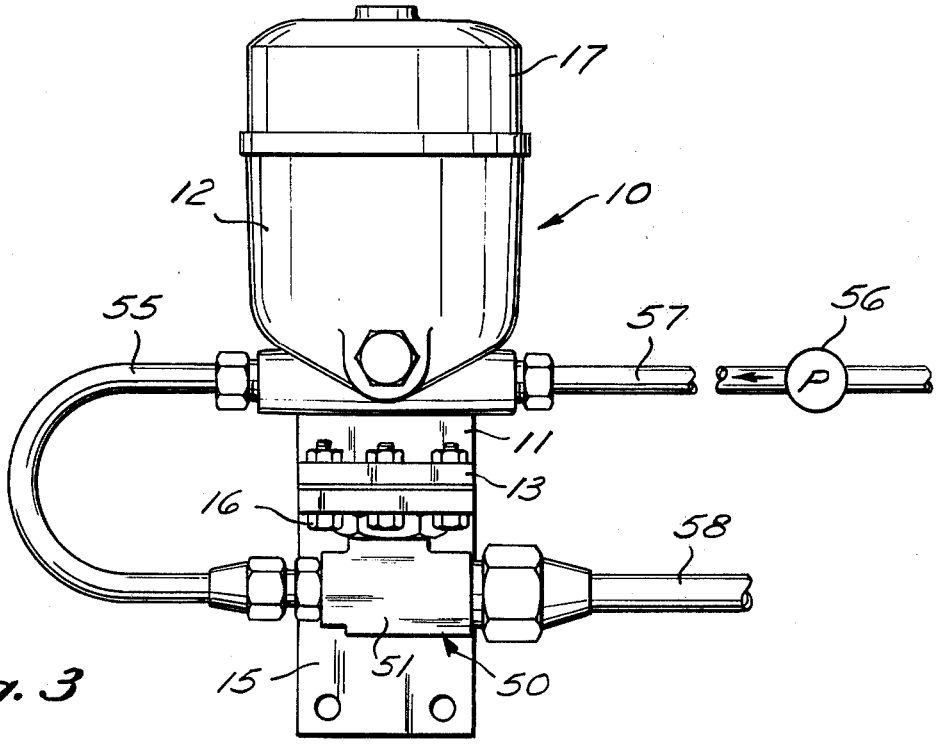
FIG. 3 is an elevational view of the separator, showing the fluid passage connections on the filter.

Referring now to FIGS. 1 through 3 of the drawings, there is illustrated a centrifugal separator 10. The separator 10 includes a base 11 having an annular wall 12 and a flanged foot structure 13 which defines an outlet port 14. The foot structure 13 is bolted to a bracket 15 by bolts 16, and the bracket 15 may be connected to any convenient member adjacent to or associated with the engine to be lubricated. A cup-shaped shroud 17 is telescoped onto the upper edge of the wall 12, and is sealed relative to the wall by a gasket 18. The shroud 17 is clamped to the base by bolts (not shown) which project through bosses (not shown) on the shroud 17 and the wall 12. The shroud 17 and the base 11 define a first chamber 19 which is in fluid communication with the outlet port 14. A cross passage 20 is bored through the base 11 and communicates with an axial passageway 21 bored in a vertical spindle 22 by way of a passageway 23 in the base 11. A plurality of outlet ports 24 are provided in the passageway 21. An isolating valve 25 is provided between the cross port 20 and the passageway 23, and is adapted to cut off flow to the separator if the supply pressure drops below 15 psi to assure maximum oil flow to the engine under start-up and low idle speed conditions.

The lower end of the spindle 22 is provided with a thrust bearing 26, which is press-fitted onto the end of the spindle and is received within a bore 27 in the base 13. The other end of the spindle 22 is provided with a thrust bearing 28 and a bushing **28*a* which is press-fitted onto the end of the spindle and is received within a bore 29 in the shroud 17.**

Carried by the vertical spindle 22 and fixed thereto by a key 30 is a rotor assembly 31, which consists of an upper body section 32 and a lower body section 33. The body sections 32 and 33 are clamped together by a nut 34 threaded onto the upper end of the spindle 22 and are sealed by a gasket 35.

Oil is fed into a second chamber 36 within the rotor 31 through the passageways 24 and egress through reaction nozzles 37 provided at the lower end of the rotor. In order to reach the reaction nozzles 37, the oil must pass through standpipes 38 within the rotor. The inlet ends of the standpipe 38 are covered with screens 39 to prevent large particles of contaminants from plugging the nozzles 37. Since oil under pressure substantially fills the second chamber 36, the upper bearings 28 and **28*a* are lubricated by oil passing through an inlet port 40 in the spindle 22 and then through an axial passageway 41. Oil is expelled from the second chamber through the tangentially mounted outlet ports 37 and, since those ports are oppositely directed, they cause the rotor 31** to rotate according to the principle of Hero's engine.

As the rotor 31 rotates, suspended solids migrate to and are retained at the sidewalls of the rotor with a force which is dependent upon the running oil pressure of the engine, which is typically between 50 and 80 psi for a diesel engine. The rotor speed usually exceeds 5000 rpm, and the force on the dirt particles exceeds 1800 g's. In time, the dirt particles and sludge form a rubber mass at the rotor sidewalls. This mass may be removed from time to time by disassembling the rotor sections 32 and 33.

It should now be appreciated that the oil in the first chamber is at substantially atmospheric pressure and heretofore was returned to the engine sump by gravity. According to prior art practices, this arrangement necessitated the mounting of the centrifugal separator at a level above the engine sump to prevent the first chamber from being flooded with engine oil to thereby inhibit rotation of the rotor.

According to this invention, a jet pump assembly 50 is provided to obviate any tendency of oil buildup in the first chamber. The assembly 50 inludes a body 51 threaded into the bracket 15 so that a pump chamber 52 is in fluid communication with the first chamber 19. A nozzle 53 is threaded through the body 51 so that it projects into the pump chamber 52 and is axially aligned with an outlet port 54. The nozzle 53 is in fluid communication with the cross passage 20 by a conduit 55, while the other end of the cross passage 20 is in communication with the engine oil pump 56 by a conduit 57. The outlet port 54 is connected to the engine sump by a conduit 58.

In operation, oil is pumped into the cross passage 20 by the pump 56, and a portion of the oil enters the second chamber through the passage 23 in the previously described manner. Another portion of the flow, however, goes directly through the cross passage to the conduit 55 and then to the jet pump 50 to sweep away fluid which may be building up in the pump chamber 52.

Figure 4:
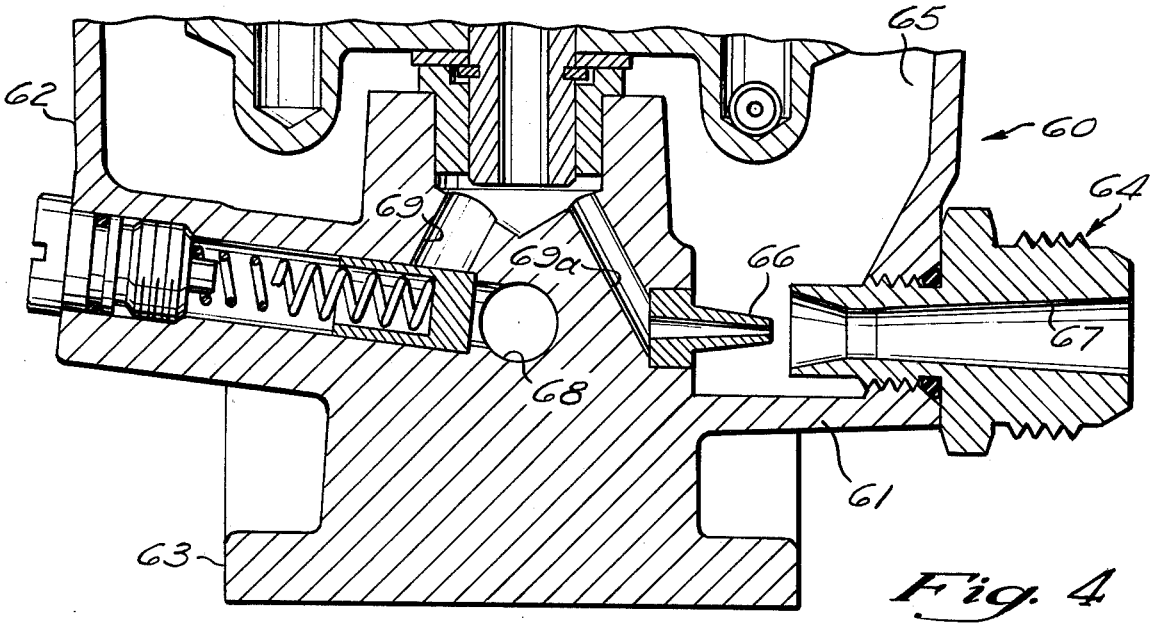
FIG. 4 is a fragmentary cross sectional view of a centrifugal filter according to a further aspect of the invention.

Referring now to FIG. 4 of the drawings there is illustrated a centrifugal separator 60 according to another aspect of this invention. The separator 60 includes a base 61 having an annular wall 62 and a foot structure 63 which is bolted to a suitable mounting bracket (not shown) adjacent to or associated with the engine to be lubricated. In other respects the centrifugal separator 60 is similar to the centrifugal separator 10 and therefore the upper portions of the separator 60 are not shown and are not described herein.

The base 61 carries a jet pump assembly 64 to alleviate any tendency of oil build up in a first chamber 65. The assembly provides a pumping action directly in the first chamber 65 and includes a nozzle 66 fitted or press fitted into the base 61 so that it projects into a lower portion of the first chamber 65 so that the lower portion of the chamber constitutes a pump chamber. The nozzle 66 is in axial alignment with an outlet port 67 threaded into the base 61. The nozzle 66 is in fluid communication with a cross port or inlet 68 by a passage 69 and a passage 69*a.* The cross passage 68 is similar to the cross passage 20 but in the embodiment shown in FIG. 4 one end of the passage 68 is blocked by a suitable plug (not shown). The open end of the cross passage 68 is in communication with an engine oil pump (not shown) but similar to the pump 56.

In operation, oil is pumped into the cross passage 68 by the pump and a portion of the oil enters the second chamber (not shown but similar to the chamber 36 in the manner previously described with reference to FIGS. 1–3). Another portion of the flow however goes from the cross passage, and through the passage 69 and the passage 69*a* to the jet pump 64 and sweeps away fluid which may be building up in the lower portion of the first chamber 65 which constitutes the pump chamber.

Figure 5:
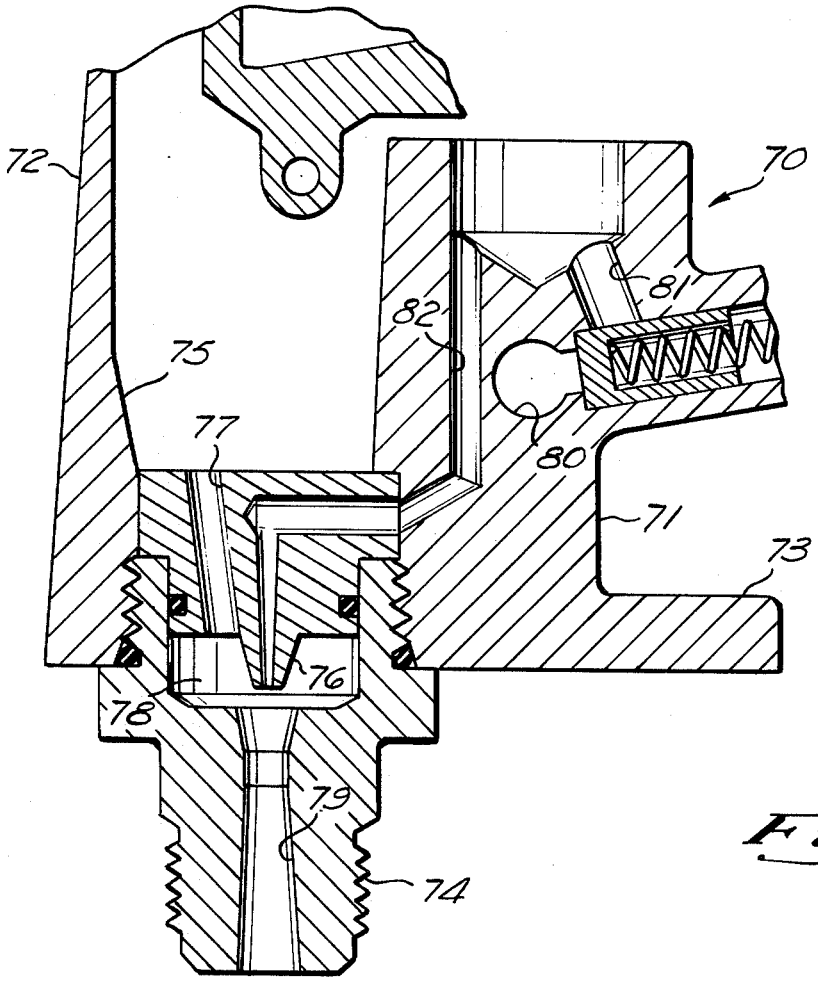
FIG. 5 is a fragmentary cross sectional view of a centrifugal filter according to a still further aspect of the invention.

Referring now to FIG. 5 of the drawings there is illustrated a centrifugal separator 70. The separator 70 includes a base 71 having an annular wall 72 and a flanged foot structure 73. The foot structure 73 is connected in any connecting manner adjacent to or associated with the engine to be lubricated. The separator 70 is similar to the separator 10 and identical parts will not be described in detail herein.

The base 71 carries a jet pump assembly 74 to alleviate any tendency of oil build up in a first chamber 75. The assembly provides a pumping action directly in the first chamber 75 and includes a nozzle 76 threaded into the base 71 so that it communicates with a lower portion of the second chamber 75 through a passageway 77 in the nozzle. In this instance, the nozzle 76 projects into a pump chamber 78. The nozzle 76 is in axial alignment with an outlet port 79 threaded into the base 71. The nozzle 76 is in fluid communication with a cross port or inlet 80 by a passage 81 and a passage 82. The cross passage 80 is similar to the cross passage 20 but in the embodiment shown in FIG. 5 one end of the passage 80 is blocked by a suitable plug (not shown). The open end of the cross passage 80 is in communication with an engine oil pump (not shown), but similar to the pump 56.

In operation, oil is pumped into the cross passage 80 by the pump and a portion of the oil enters the second chamber (not shown but similar to the chamber 36 and the manner previously described with reference to FIGS. 1–3). Another portion of the flow goes from the cross passage and through the passage 81 and the passage 82 to the jet pump 74 and sweeps away fluid which may be building up in the lower portion of the first chamber 75.

While the invention has been described in connection with specific embodiments thereof, it is to be clearly understood that this is done only by way of example, and not as a limitation to the scope of the invention as set forth in the objects thereof and in the appended claims.

What is claimed is:

1. A centrifugal separator for separating contaminants from contaminated fluids and which may be mounted in a variety of positions relative to an engine block, comprising shroud means defining a first chamber, a vertically extending spindle within said shroud means and having a hollow rotor mounted thereon for axial rotation within said shroud means, said hollow rotor defining a second chamber for receiving contaminated fluids to be separated, fluid inlet means through said spindle for conducting such contaminated fluids to said second chamber, first pump means in fluid communication with said fluid inlet means to pump fluids to said fluid inlet means, means to rotate said rotor and thereby cause said contaminants in contaminated fluids within said chamber to migrate toward a sidewall of said second chamber under the influence of centrifugal force and to be separated from such contaminated fluids, said means to rotate said rotor comprising tangentially mounted outlet port means on said rotor to cause said rotor to rotate upon discharge of fluid from said second chamber to said first chamber, second pump means comprising a jet pump having a pump chamber in fluid communication with said first chamber to prevent excess fluid buildup in said first chamber which would inhibit rotation of said rotor, a nozzle projecting into said pump chamber, an outlet from said pump chamber aligned with said nozzle, and a passageway communicating with said fluid inlet means, said passageway in turn being in fluid communication with said first pump means and with said nozzle, whereby a portion of said fluid will be delivered by said first pump means to said second chamber and a portion of said fluid will be delivered by said first pump means to said second pump means.

2. A centrifugal separator according to claim 1 wherein said second pump means comprises a jet pump positioned in a wall defining said shroud means.

3. A centrifugal separator according to claim 1 wherein said pump chamber is a portion of said first chamber.

4. A centrifugal separator for separating contaminants from contaminated fluids, comprising shroud means defining a first chamber, a vertically extending spindle within said shroud means and having a hollow rotor mounted thereon for axial rotation within said shroud means, said hollow rotor defining a second chamber for receiving contaminated fluids to be separated, fluid inlet means through said spindle for conducting such contaminated fluids to said second chamber, a cross passage through a base portion of said shroud, means providing fluid communication between said fluid inlet means and said cross passage, first pump means in fluid communication with an inlet port of said cross passage, means to rotate said rotor and thereby cause said contaminants in contaminated fluids within said second chamber to migrate toward a sidewall of said second chamber under the influence of centrifugal force and to be separated from such contaminated fluids, said means to rotate said rotor comprising tangentially mounted outlet port means on said rotor to cause said rotor to rotate upon discharge of fluid from said second chamber to said first chamber, and second pump means comprising a jet pump having a pump chamber in fluid communication with said first chamber to prevent excess fluid buildup in said first chamber which would inhibit rotation of said rotor, a nozzle projecting into said pump chamber and having an inlet in fluid communication with an outlet port of said cross passage and having an outlet aligned with said nozzle, whereby a portion of said fluid will be delivered by said first pump means to said second chamber and a portion of said fluid will be delivered by said first pump means to said second pump means.

5. A centrifugal separator according to claim 4, wherein said second pump means comprises a jet pump having a pump chamber in fluid communication with said first chamber, a nozzle projecting into said pump chamber and having an inlet in fluid communication with an outlet port of said cross passage, and an outlet aligned with said nozzle, whereby a portion of said fluid will be delivered by said first pump means to said second chamber and a portion of said fluid will be delivered by said first pump means to said second pump means.

6. A centrifugal separator for separating contaminants from contaminated fluids and which may be mounted in variety of positions relative to an engine block, comprising shroud means defining a first chamber, a vertically extending spindle with said shroud means, and having a hollow rotor mounted thereon for axial rotation within said shroud means, said hollow rotor defining a second chamber for receiving contaminated fluids to be separated, fluid inlet means through said spindle for conducting such contaminated fluids to said second chamber, means to rotate said rotor and thereby cause said contaminants in contaminated fluids within said second chamber to migrate toward a sidewall of said second chamber under the influence of centrifugal force and to be separated from such contaminated fluids, said means to rotate said rotor comprising tangentially mounted outlet port means on said rotor to cause said rotor to rotate upon discharge of fluid from said second chamber to said first chamber, and pump means comprising a jet pump having a pump chamber, said pump chamber having an inlet in fluid communication and in fluid pumping communication with said first chamber to prevent excess fluid buildup in said first chamber which would inhibit rotation of said rotor, a nozzle projecting into said pump chamber, an outlet aligned with said nozzle, and a passageway communicating with said fluid inlet means and said nozzle, whereby a portion of said fluid will be delivered to said second chamber by said fluid inlet means and a portion of said fluid will be delivered by said fluid inlet means to said pump means.

* * * * *

UNITED STATES PATENT OFFICE

CERTIFICATE OF CORRECTION

Patent No. 4,046,315 Dated September 6, 1977

Inventor(s) James C. Klingenberg et al.

It is certified that error appears in the above-identified patent and that said Letters Patent are hereby corrected as shown below:

Column 4, lines 65 and 66, "within said chamber" should read --within said second chamber--.

Column 6, line 22, "with said shroud means" should read --within said shroud means--.

Signed and Sealed this

*Twentieth* Day of *December 1977*

[SEAL]

*Attest:*

RUTH C. MASON
*Attesting Officer*

LUTRELLE F. PARKER
*Acting Commissioner of Patents and Trademarks*